US008987575B1

(12) United States Patent
Rossel

(10) Patent No.: US 8,987,575 B1
(45) Date of Patent: Mar. 24, 2015

(54) AUTOMATED TIHAI CLOCK

(71) Applicant: William Christian Rossel, San Anselmo, CA (US)

(72) Inventor: William Christian Rossel, San Anselmo, CA (US)

( * ) Notice: Subject to any disclaimer, the term of this patent is extended or adjusted under 35 U.S.C. 154(b) by 0 days.

(21) Appl. No.: 14/015,162

(22) Filed: Aug. 30, 2013

(51) Int. Cl.
*G10H 7/00* (2006.01)
*G10H 1/40* (2006.01)

(52) U.S. Cl.
CPC ..... *G10H 1/40* (2013.01)
USPC ..... 84/636

(58) Field of Classification Search
CPC ..... G10H 2230/115
USPC ..... 84/636
See application file for complete search history.

(56) References Cited

U.S. PATENT DOCUMENTS

| | | | | |
|---|---|---|---|---|
| 4,759,253 | A * | 7/1988 | Harle et al. | 84/484 |
| 5,214,228 | A * | 5/1993 | Hoiles et al. | 84/470 R |
| 6,201,769 | B1 * | 3/2001 | Lewis | 368/10 |
| 6,362,409 | B1 * | 3/2002 | Gadre | 84/603 |
| 6,750,387 | B2 * | 6/2004 | Jamkhedkar et al. | 84/483.2 |
| 7,582,822 | B1 * | 9/2009 | Olander-Waters et al. | 84/484 |

* cited by examiner

*Primary Examiner* — Jeffrey Donels
(74) *Attorney, Agent, or Firm* — Patent Law Offices of Michael E. Woods; Michael E. Woods

(57) ABSTRACT

A system and method for creating and visualizing valid tihais conforming to a predetermined framework using a rhythm engine, mechanical or software/firmware controlled, to control an interrelationship of a set of dynamic indicators.

11 Claims, 6 Drawing Sheets

AUTOMATED TIHAI CLOCK

FIELD OF THE INVENTION

The present invention relates generally to calculation and presentation of cadential figures, and more specifically, but not exclusively, to generation of different tihais.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Hindustani classical music, the classical music of Northern India, is a musical system that functions within a rhythmic framework that is cyclic. This cyclic rhythm framework is known as Taal or Tala. Many talas exist and include various numbers of beats, the most common of which is made up of 16 beats and is known as Teental (or Tintal, Tintaal, among other variations). Other cycles, however, exist made up of 6, 7, 10, and 12 beats, just to name a few of the more common talas (known as Dadra, Rupak, Jhaptal and Ektal respectively). Some talas even exist that are made up of fractional numbers of beats; 6½ beats, 8½ beats, and 10¼ beats are examples of this.

Within any tala there exists a hierarchy of beats with the most prominent beat being the first beat of the cycle. This first beat is known as the sam (pronounced sum) and is represented by a plus (+) sign.

The Tihai

The Tihai is a ubiquitous cadential figure within Hindustani music that consists of a rhythmic phrase, expressed either percussively or melodically, which is repeated three times and which commonly resolves to the first beat of the tala (the sam), or to other prominent places within the tala. In performance situations, the general theory is that the first repetition introduces the musical material of the tihai to the audience, while during the second repetition they discern that a tihai is being played and by the third repetition are anticipating its cathartic resolution to the sam.

The Palas

Each of the three repetitions of a tihai is known as a pala, therefore, tihais are said to be made up of three palas, where the palas are of equal length. There are some rare exceptions that break this rule, where the last pala of a tihai is either compressed or expanded to create a sense of surprise, or where the palas successively expand or contract, but from this point onwards, it will be assumed that the three palas of any given tihai are of equal length, as this is the case with the vast majority of tihais. It will also be assumed that the two gaps separating the 3 palas are of equal length.

Tihais may start on any beat, or at any point in between any two beats in any tala, and the palas of a tihai may be of any arbitrary length. The primary musical function of tihais is to create a sense of rhythmic tension and anticipation that is resolved with a strong feeling of arrival, cadence, or catharsis when the tihai concludes.

An example of a simple tihai in Teental may be notated as follows:

| 1 | 2 | 3 | 4 | 5 | 6 |
|---|---|---|---|---|---|
| '(+)Tete | 'kata | 'gedi | 'gene | 'dha– | '– |
| 7 | 8 | 9 | 10 | 11 | 12 |
| 'tete | 'kata | 'gedi | 'gene | 'dha– | '– |
| 13 | 14 | 15 | 16 | 1 | |
| 'tete | 'kata | 'gedi | 'gene | '(+)dha | |

Here the phrase "tete kata gedi gene dha" (which represents a musical phrase played on Tabla, a prominent North Indian drum) is being repeated 3 times. The tihai begins and ends on sam (+). The apostrophes (') represent the 16 beats of the rhythm cycle (there are 17 apostrophes in this example, including the sam of the following cycle). Each pala is 4 beats long with a punctuating note (dha) on the 5th beat, and there are 3 half-beats of space in between each pala (notated as: -'-).

When learning to play an instrument that is able to implement such a rhythmic cycle, it can be challenging to learn the mechanics of properly playing individual notes as well as visualizing and producing proper tihais. Students have not had a system or method creating and visualizing valid tihais conforming to a predetermined framework.

What is needed is a system and method for creating and visualizing valid tihais conforming to a predetermined framework.

BRIEF SUMMARY OF THE INVENTION

Disclosed is a system and method for creating and visualizing valid tihais conforming to a predetermined framework.

The following summary of the invention is provided to facilitate an understanding of some of technical features related to the generation and visualization of a tihai, and is not intended to be a full description of the present invention. A full appreciation of the various aspects of the invention can be gained by taking the entire specification, claims, drawings, and abstract as a whole. The present invention is applicable to other musical systems and rhythmic frameworks besides the Tala and the tihais presented herein and may be implemented in other formats, such as a mechanical "clock" that includes a set of mechanical hands responsive to a set of planetary gears that implement the relationships explicitly and implicitly described herein.

An aspect of the present invention includes a rhythm engine that controls a position and location of various indicators, and that rhythm engine may be implemented in hardware or software. The rhythm engine embodies a set of special ratios among the indicators, and movement of one indicator can, as described herein, control movement of one or more other indicators depending upon a motion type selected from A motion, B motion, and/or C motion.

In several embodiments, whether largely hardware or largely software, the indicators are rendered using a circular paradigm to represent the cycles. This is a simple yet powerful way to visualize the continuity of the pattern(s) indicated by the indicators. Some implementations may not represent the cycles in a circle, but could use other paradigms, such as a linear progression along a scale. Software implementations of a rhythm engine controlling indicators rendered on a display may be easily adapted to such implementations.

A method for generating a rhythmic cycle represented by a set of indicators, the method comprising: (a) rendering the set of indicators relative to a beat cycle pattern using a machine, the beat cycle pattern including a number N beats per cycle, the set of indicators including 6 indicators that have a predefined relative dependent motion relationship to each other within the beat cycle pattern; (b) repositioning a location of a first particular one indicator of the set of indicators; and thereafter (c) repositioning a location of one or more indicators of the set of indicators other than the first particular one indicator responsive to the predefined relative dependent motion relationship to generate the rhythmic cycle represented by the locations of the set of indicators within the beat cycle pattern.

A machine for generating a rhythmic cycle represented by a set of indicators, comprising: a dial face defining a beat cycle pattern including a number N beats per cycle; a rhythm engine, coupled to the set of indicators that include 6 indicators that have a predefined relative dependent motion relationship to each other within the beat cycle pattern, configured to position a location of each of the 6 indicators relative to the dial face; and an interface configured to reposition a location of a first particular one indicator of the set of indicators; wherein the rhythm engine automatically repositions a location of one or more indicators of the set of indicators other than the first particular one indicator responsive to the predefined relative dependent motion relationship to generate the rhythmic cycle represented by the locations of the set of indicators within the beat cycle pattern.

A non-transitory machine readable storage medium having stored thereon a computer program for visualizing a set of six indicators rendered with respect to a cycle background, the computer program comprising a routine of set instructions for causing the machine to perform the steps of: (a) rendering the set of indicators relative to a beat cycle pattern using a machine, the beat cycle pattern including a number N beats per cycle, the set of indicators including 6 indicators that have a predefined relative dependent motion relationship to each other within the beat cycle pattern; (b) repositioning a location of a first particular one indicator of the set of indicators; and thereafter (c) repositioning a location of one or more indicators of the set of indicators other than the first particular one indicator responsive to the predefined relative dependent motion relationship to generate the rhythmic cycle represented by the locations of the set of indicators within the beat cycle pattern.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 2 illustrates a possible default start up screen;

FIG. 3 illustrates a first example of a user interaction with the startup screen of FIG. 2;

FIG. 4 illustrates a second example of a user interaction with the first example of FIG. 3;

FIG. 5 illustrates a third example of a user interaction with the second example of FIG. 4; and FIG. 6 illustrates a fourth example of a user interaction with the first example of FIG. 3.

DETAILED DESCRIPTION OF THE INVENTION

Figure 1:
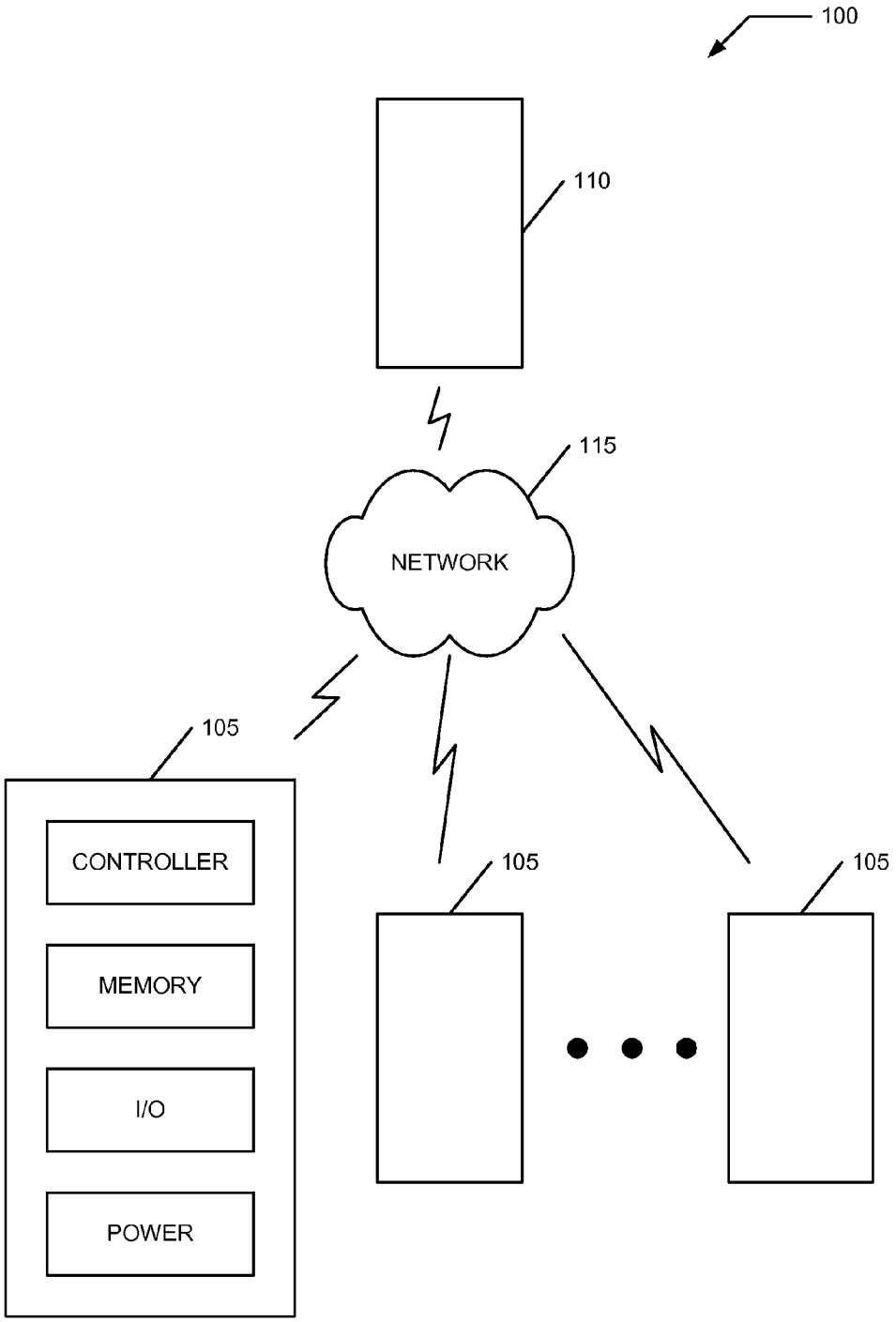
FIG. 1 illustrates a system that creates and visualizes one or more valid tihai conforming to a predetermined framework.

Embodiments of the present invention provide a system and method for creating and visualizing valid tihais conforming to a predetermined framework. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

DEFINITIONS

The following definitions apply to some of the aspects described with respect to some embodiments of the invention. These definitions may likewise be expanded upon herein.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting," refer to immediate real or virtual attachment or linking. Connected objects have no substantial intermediary object or set of objects.

As used herein, the terms "couple," "coupled," and "coupling" refer to an operational connection or linking. Coupled objects can be directly connected to one another or can be indirectly connected to one another, such as via an intermediary set of objects.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

Relationship

A cycle generator, whether implemented in one or more mechanical, electromechanical, combinatorial, or microprocessor versions, includes a set of relationships among the cycle component indicators, such as:

When $p_{3b}=1$ (i.e. the tihai ends on sam), use Formula (1):

$$tc=b+3p+2g \quad (1)$$

When $p_{3b}>1$ (i.e. the tihai does not end on sam), use Formula (2):

$$tc=b+3p+2g+(t+1-p_{3b}) \quad (2)$$

Where:

$p_{3b}=3^{rd}$ pala's ending point;

t=# of beats in the tala;

c=# of complete cycles in which the tihai is contained (always an integer);

$b=p_{1a}-1$=# of beats in the cycle from sam before $p_a$ appears;

$p=(p_{1b}+tc_{1b})-p_{1a}$=# of beats in each pala;

$g=(p_{2a}+tc_{2a})-(p_{1b}+tc_{1b})$=# of beats in each gap;

$p_{1a}=1^{st}$ pala's starting point;

$p_{1b}=1^{st}$ pala's ending point;

$c_{1b}$=# of completed cycles before $p_{1b}$ appears (always an integer);

$p_{2a}=2^{nd}$ pala's starting point; and $c_{2a}$=# of completed cycles before $p_{2a}$ appears (always an integer).

Tihai Digital Clock

The Tihai Clock is a method for calculating all possible tihais, from any point within any tala, of any length pala and resolving to any beat. It includes two embodiments, one mechanical and one digital though other embodiments are possible using the present invention. Both embodiments are essentially methods for expressing the aforementioned mathematical formulas and ratios and both embodiments make use of a clock-like interface with movable hands to represent the starting and ending points of the various palas. The talas are represented as circular dials around the face of the clock which are rotatable and removable and where every number on the dial is evenly spaced and represents a beat in the tala. There are multiple dials for the various talas which can be alternately used.

There are six hands grouped into three pairs (one pair per pala). The hands are labeled 1A (beginning of pala 1), 1B (end of pala 1), 2A (beginning of pala 2), 2B (end of pala 2), 3A (beginning of pala 3), and 3B (end of pala 3).

The hands of pala 2 (2A and 2B) are invertible, i.e. they can be made to indicate points 180° from their present locations (e.g. if 2A and 2B are pointing to the "12 o'clock" position, they can be inverted to point to the "6 o'clock" position) without any of the other hands moving. Both hands must be inverted simultaneously (i.e. one cannot invert 2A without inverting 2B). In a mechanical embodiment this inversion characteristic of the $2^{nd}$ pala could be represented by making hands 2A and 2B double-ended, like a magnetic needle of a compass. This means that any configuration of the hands on the clock would be a representation of not one, but two tihais, one with a shorter gap between the palas and one with a longer gap between the palas.

The movements of the six moving hands in relation to one another can be categorized as three types (A motion, B motion, and C motion), each governed by a set of ratios:

A motion=Δ1A:Δ2A:Δ3A

B motion=Δ1B:(−½)Δ2A:(½)Δ2B:(−1)Δ3A

C motion=Δ1A:Δ1B:Δ2A:Δ2B:Δ3A:Δ3B

In a possible mechanical embodiment, the last hand (3B) does not move and is fixed at a particular location (e.g., in the "12 o'clock" position (pointing straight up). In this case there would be only five moving hands, not six.

In essence, A motion and B motion both affect pala and gap length. A motion controls the position of hand 1A (and in turn 2A and 3A, i.e. the starting points of each pala) and B motion controls the position of hand 1B (and in turn 2A, 2B and 3A, i.e. the starting and ending points of the 2nd pala, as well as the starting point of the 3rd pala).

C motion affects all the hands equally and would not affect pala or gap length. It merely enables the present tihai to be shifted to alternate positions within the rhythm cycle.

The fact that there are negative terms in the ratios governing B motion (−½ and −1) means that when hand 1B is moving in clockwise motion, then hands 2A and 3A will be moving in counterclockwise motion. This motion in the hands is achieved in the Tihai Clock by the relevant real or virtual motion control for hands 2A and 3A.

Inside a mechanical Tihai Clock, there may be a central set of gears connected to the hands via concentric shafts. This central set of gears meshes with two separate sets of gears (one to dictate A motion and one to dictate B motion). The user rotates one of these two sets of gears (A or B) to affect the motion of the hands and to calculate tihais.

Anagat and Atit Tihais (and Other "Non-Sam" Resolutions)

Not all tihais are resolved to the sam (first beat) of the tala. Some tihais, known as anagat tihais, are resolved before (though not by more than ½ a beat before) the sam. Others, known as atit tihais, are resolved after (though not by more than ½ a beat after) the sam.

Other times, tihais may be resolved to other locations of prominence within the tala. A good example of this is the beginning (mukra) of an instrumentalist's or vocalist's melodic theme (gat) which commonly occurs at the 12th beat in Teental (16 beat cycle), but which can occur at any other point in the tala.

These "non-sam" resolving tihais can be represented using C motion, as it is the only motion that affects hand 3B.

The mechanical embodiment of the Tihai Clock is capable of representing these non-sam resolving tihais by rotating the dial until hand 3B, the hand fixed in the "12 o'clock" position (i.e. the end of the last pala), 1 is pointing to the desired point of resolution. For example, when a user wants to calculate tihais that resolved to the 12th beat, they would simply rotate the dial till hand 3B was pointing to beat 12. Every configuration of the hands at this point would be a description of tihais resolving to the 12th beat.

The digital embodiment of the Tihai clock includes computer programs and mobile device (touch screen) applications (apps) in which the mathematical formulas and ratios governing the movement of the hands are part of the program code. The user interface of the digital embodiment of the Tihai Clock is essentially the same as in the mechanical embodiment, e.g., a clock with a circular dial, the numbers of which represent the beats in the tala, and 3 pairs of hands labeled 1A, 1B, 2A, 2B, 3A and 3B which point to the starting and ending points of the palas.

The user selects from a drop-down menu the tala in which they want to calculate tihais. The numbers of the beats in that particular tala will be automatically displayed, spaced evenly around the dial of the clock. The user can then select the starting point from which the tihai will begin as well as the length of the palas for the tihai. The starting points and ending points of the palas are graphically represented using clock hands in the same manner as with the mechanical Tihai Clock. In addition the user has an option to hear the tihai being played as a series of chimes or musical sounds/phrases which represent the tihai, against other possible musical accompaniments which represent the passage of the tala. (These could be metronome clicks, rhythmic phrases known as theka or melodic phrases known as the lehera or nagma).

Electronic and electromechanical implementations may also optionally include additional functions:

(1) a "Tune function" that enables the user to set and fine-tune a centralized pitch to which the drone, the forms of accompaniment (nagma and theka) and the chimes marking the A hands and the B hands would all be tuned;

(2) a "Mute-chimes function" that when engaged, would allow the user to mute the tihai chimes and would cause only the drone and accompaniment features to be heard;

(3) a "Repeat function" that when engaged causes the system to endlessly repeat the accompaniment and the chimes of the tihai. When disengaged, the system plays through the tihai once and then stops (when the tihai ends before the first beat, then the app will continue playing the accompaniment until the first beat is reached and then stop). The drone function would not be affected by the repeat function (i.e. the drone is either constantly on or constantly off dependent on the drone toggle switch);

(4) a "Tempo function" that enables the user to set and adjust the speed of playback;

(5) a "Drone function" that when engaged would create a perpetual drone either by audio samples or by a synthesizer whose pitches would be defined by the "Tune function";

(6) an "Accompaniment function" that when engaged would play one or more forms of accompaniment (see below);

(7) an "Invert $2^{nd}$ pala function" that when toggled would cause hands 2A and 2B to indicate points 180° around the clock from their original positions. For example, if hand 2A is pointing at 7 and 2B is pointing at 11, then after this feature is selected, 2A will be pointing at 15 and 2B will be pointing at 3;

(8) a "Snap to resolution function" that when engaged, the hands will snap to the nearest interval as dictated by the Resolution. For example, if the resolution is set to the beat then the hands will snap only to the beats in a quantized fashion. If the resolution were set to ½ a beat then the hands would snap only to the beats and to the half beats. If the resolution were ¼ beat then the hands would snap only to the beats, the half beats and the quarter beats, and so on. When disengaged the hands would move smoothly through all beats and points inbetween the beats;

(9) a "Manual input function" that would enable users to manually input certain values to generate tihai. For example they could type in a numeral for the desired pala length and/or starting and ending points of the tihais, or a sufficient number of knowns to have the system solve for the unknown values of the parameters of the rhythm engine; and

(10) a "Visualization function" that would indicate graphically the passage of musical time around the rhythm cycle. This could be implemented, for example, by having the indicators (e.g., the numerals) on the clock face brighten in sequence, in syncronization with any audible elements of the application.

Accompaniment Feature (and the Concepts of Nagma and Theka)

1. The system preferably implements a "Click" would be simply a metronome audible sound (e.g., a click) that would be heard equally on all beats.

2. A Nagma (or Lehera) is a melodic phrase played by any melodic instrument (usually harmonium) that lasts one cycle long.

3. A Theka is a rhythmic phrase played by tabla (a North Indian drum) that lasts one cycle.

Each rhythm cycle has Nagmas and Thekas that are specific to it.

The system may have audio samples and/or a synthesizer that would play the appropriate accompaniments alternatively or simultaneously (e.g., the user could choose to hear either the nagma, the theka or the metronome click individually or in any combination).

A complete identification of a particular configuration, or related sets of configurations, and associated options may be stored as a cycle/set profile that can be stored locally or remotely (e.g., a server) and recalled or shared with others.

Digital Implementation

The following description is representative of a user interface for creating and rendering (e.g., visualizing and/or audibilizing) one or more valid rhythmic cycles. There are many different ways of implementing such a user interface besides the computerized display implementation illustrated in FIG. 1-FIG. 6. Mechanical and electromechanical implementations include mechanical "clocks" that include mechanical hands that move in the described relationships responsive to, for example, a set of planetary gears. Other implementations of the interface are also possible.

FIG. 1 illustrates a system 100 that creates and renders one or more valid rhythmic cycles conforming to a predetermined framework. System 100 includes an electronic device 105 that is optionally communicated to a server 110 over a communications modality 115. Electronic device 105 of FIG. 1 includes a general purpose computing system having a controller, a memory, an input/output (I/O) subsystem, and a power subsystem. Electronic device 105 may be implemented in many different formats including a desktop computing personal computer, a portable computing environment including laptop computers, smartphones, tablet computers, personal digital assistants, and the like.

Electronic device 105 includes a stored program machine that includes a microprocessor, microcontroller, or other executive subsystem that operates on a set of executable instructions retrieved from a storage system (volatile and/or non-volatile, internal and/or external) such as the memory included with electronic device 105 or accessible by electronic device 105 (optical disk, removable memory card, USB flash drive, and the like). The executive subsystem in cooperation with the set of executable instructions configure operation as described herein.

The I/O subsystem includes a renderer, preferably a display most preferably integrated into a housing containing electronic device 105 though a discrete/external display or rendering system is also within the scope of the present invention. The I/O subsystem further includes one or more mechanisms for receiving user input/control, such as buttons or other control objects, for effecting user input direction. These buttons may be virtual and implemented by a touch-responsive display. A touch responsive display may render visible control elements on the display and record user selection, movement, and/or operation of the element and associate such selection, movement, and/or operation with particular user input directives. Such an implementation provides flexibility in the presentation of dynamic control elements and allow for an updated display to reflect the results of the user interaction. The rendering system may include in addition to, or in lieu of, the display system other rendering subsystems such as an audiblizer (e.g., an acoustic transducer) that generates audio signals. In addition, electronic device 105 includes a power source, e.g., a battery (e.g., rechargeable secondary cell(s)), configured to power the controller, memory, and/or I/O subsystem.

In many implementations, electronic device 105 may be fully self-contained to operate without other systems, such as server 110. In other implementations, server 110 may provide certain partially or wholly supporting functions. For example, server 110 (also a stored program computing system) may include a database that stores predetermined valid rhythmic cycles that may be of particular interest to an individual. These cycles may be accessed and implemented by electronic device 105, such as downloading from server 110 a set of data that identifies/configures the desired cycle on electronic device 105. Communications modality 115 includes wired and/or wireless implementations that transfer the data between electronic device 105 and server 110.

Figure 2:
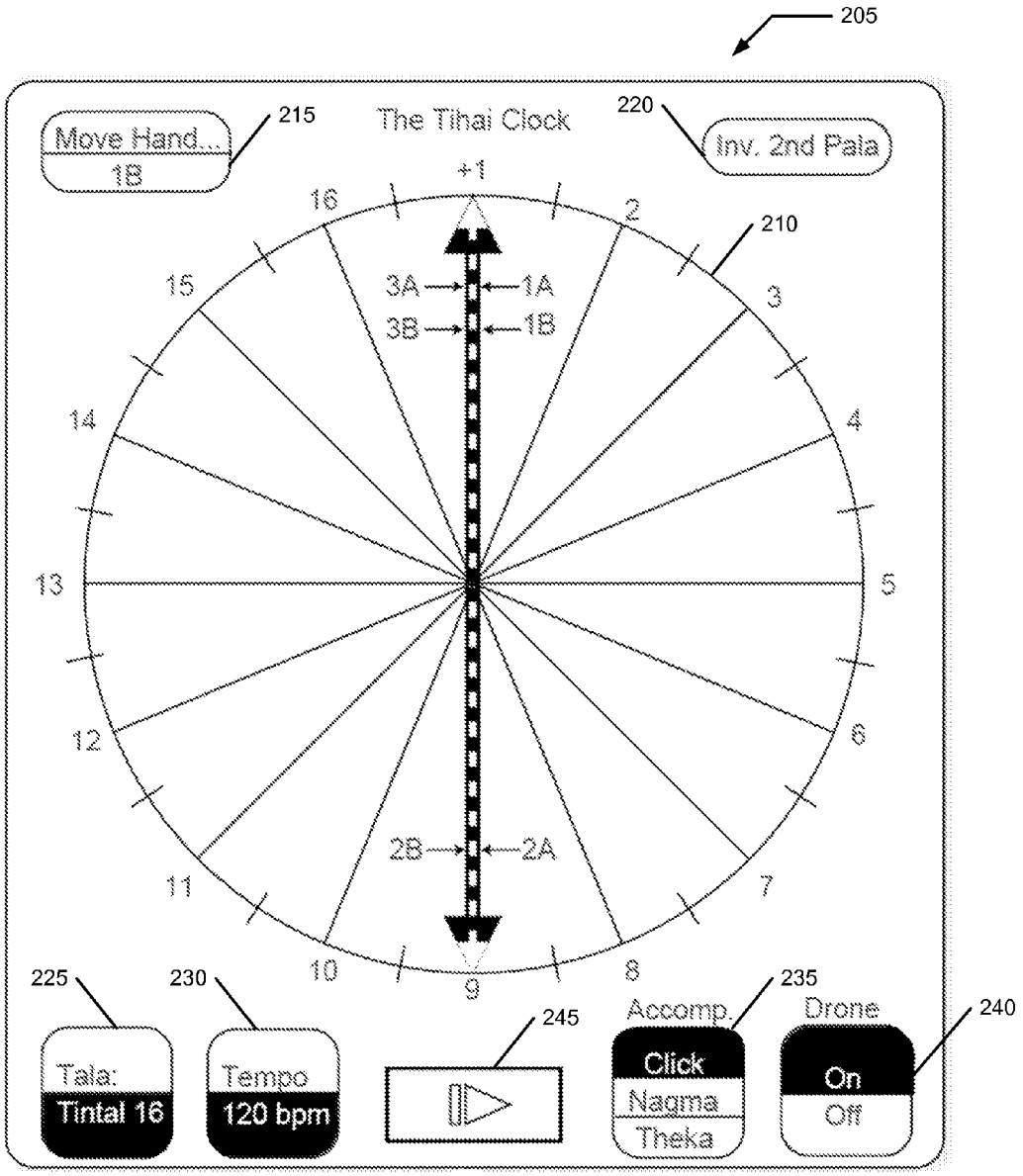
FIG. 2-FIG. 6 illustrate a set of representative user interfaces rendered on a display.

FIG. 2-FIG. 6 illustrate a set of representative user interfaces rendered on a display associated with electronic device 105. FIG. 2 illustrates a possible default start up screen 205 rendered on the display. Screen 205 defines one possible user interface configuration out of a myriad of potential configurations. As well known, some of the features and controls described below may be implemented using menus or settings controls that enable some of the control elements to be moved off of, while other control elements could be added to, screen 205.

The control elements of screen 205 enable a user to define a cycle such as by moving one or more hands, change the rhythm cycle, change/set accompaniment/drone and invert the second pala and render (e.g., "play" the cycle) with selected options (e.g., accompaniment, drone, and the like).

Screen 205 presents a number of user-interactable control elements that allow a user to provide input to electronic device 105. As illustrated in FIG. 2-FIG. 6, these control elements include a set of virtual "hands" identified as hand 1A, hand 1B, hand 2A, hand 2B, hand 3A, and hand 3B. Screen 205 depicts hand 1A, hand 1B, hand 3A, and hand 3B overlapping each other and pointing straight up while hand 2A and hand 2B overlap each other and point straight down opposite of the other hands.

The hands are rendered on a virtual dial 210 that includes regular peripheral demarcations that identify the number of beats in the cycle. Screen 205 illustrates a cycle having 16 evenly spaced beats, with whole beats and half-beats both set forth. A starting, or reference beat at the top (e.g., 0 degrees) is identified as beat "+1" and numbered consecutively clockwise around dial 210.

Representative control elements include a hand movement control 215, a menu 220, a tala control 225, a tempo control 230, an accompaniment control 235, a drone control 240, and a play control 245.

Hand movement control 215 allows a user to select one hand (e.g., one of hands 1A, 1B, 2A, 2B, 3A, and 3B) for operation. The operation includes movement of the selected to a different position/location on dial 210. Movement of one hand may affect the movement and location of other non-selected hands according to the programmed relationship (for example, the relationship (1) defined herein). Hand movement control 215 may also visualize the selected hand so the user can easily tell which hand is selected. Optionally the selected hand may be presented in a way that identifies it as the selected hand (e.g., flashing hand).

For example:

1. When the user chooses to move hands 1A, 2A or 3A, then hands 1A, 2A and 3A will all move at the same rate, regardless of their configuration.

A Motion: Δ1A:Δ2A:Δ3A.

2. When the user chooses to move hands 1B or 2B, then hands 1B, 2A, 2B and 3A move according to the following ratio:

B Motion: Δ1B:(−½)Δ2A:(½)Δ2B:(−1)Δ3A

3. When the user chooses to move hand 3B, then all hands will move at the same rate, regardless of their configuration.

C Motion: Δ1A:Δ1B:Δ2A:Δ2B:Δ3A:Δ3B

There are many ways that the user interface may be implemented to identify a "move to" location for a selected hand. For example, hand control 215 may select "hand 1B" and the user may then, for a touch-responsive display, tap a beat demarcation (e.g., beat number 5) and electronic device 105 renders hand 1B at beat 5 (and may change the location of the other hands as determined by the relationship formulae (e.g., A-C motion)).

Menu control 220 allows, among other things, the user to invert the $2^{nd}$ pala. This toggle switch causes hands 2A and 2B to each revolve 180° around the clock from their positions. For example, if hand 2A is pointing at 7 and 2B is pointing at 11, then after this feature is selected, 2A will be pointing at 15 and 2B will be pointing at 3 (for a 16 beat tala).

Tala control 225 provides a menu option for the user to select a desired tala, such as from Table A below (with tala control optionally visualizing the selected option).

TABLE I

Representative Tala Selections

| Tala Name | Beats/Cycle |
|---|---|
| Tintal | 16 |
| Pancham Sawari | 15 |
| Ada Chautal | 14 |
| Dhammar | 14 |
| Jaital | 13 |
| Ektal | 12 |
| Asta Mongal | 11 |
| Jhaptal | 10 |
| Mattatal | 9 |
| Keherwa | 8 |
| Rupak | 7 |
| Dadra | 6 |

Tempo control 230 allows a user to select a desired tempo (beats per minute), such as a choice in a range in 1 beat/minute intervals, or may allow the user to enter the desired value without limitation by menu options. The preconfigured range of a preferred embodiment may be 1-500 beats per minute (bpd), though other implementations are not limited in this way. The Temp control 230 identifies the selected tempo.

Accompaniment control 235 allows the user to select and identify the type of accompaniment. For example, one or more of click, Nagma, and/or Theka may be selected.

Drone control 240 enable the user to select and identify whether the drone feature is on.

Play control 245 enables the user to start, and stop, listening to the tihai configured by electronic device 105. There are many ways of listening to the configured tihai, and the available options are not all identified by the range of options explicitly described above. For example, a metronome click marks each beat as the numbers around dial 210 light up in sequence (at the selected tempo), indicating where the beat is currently falling. A chime will be heard on the beats indicated by the hands. In the case of the default tihai as show in FIG. 2, there will be a chime on beat 1, on beat 9, and on beat 1 once again.

Figure 3:
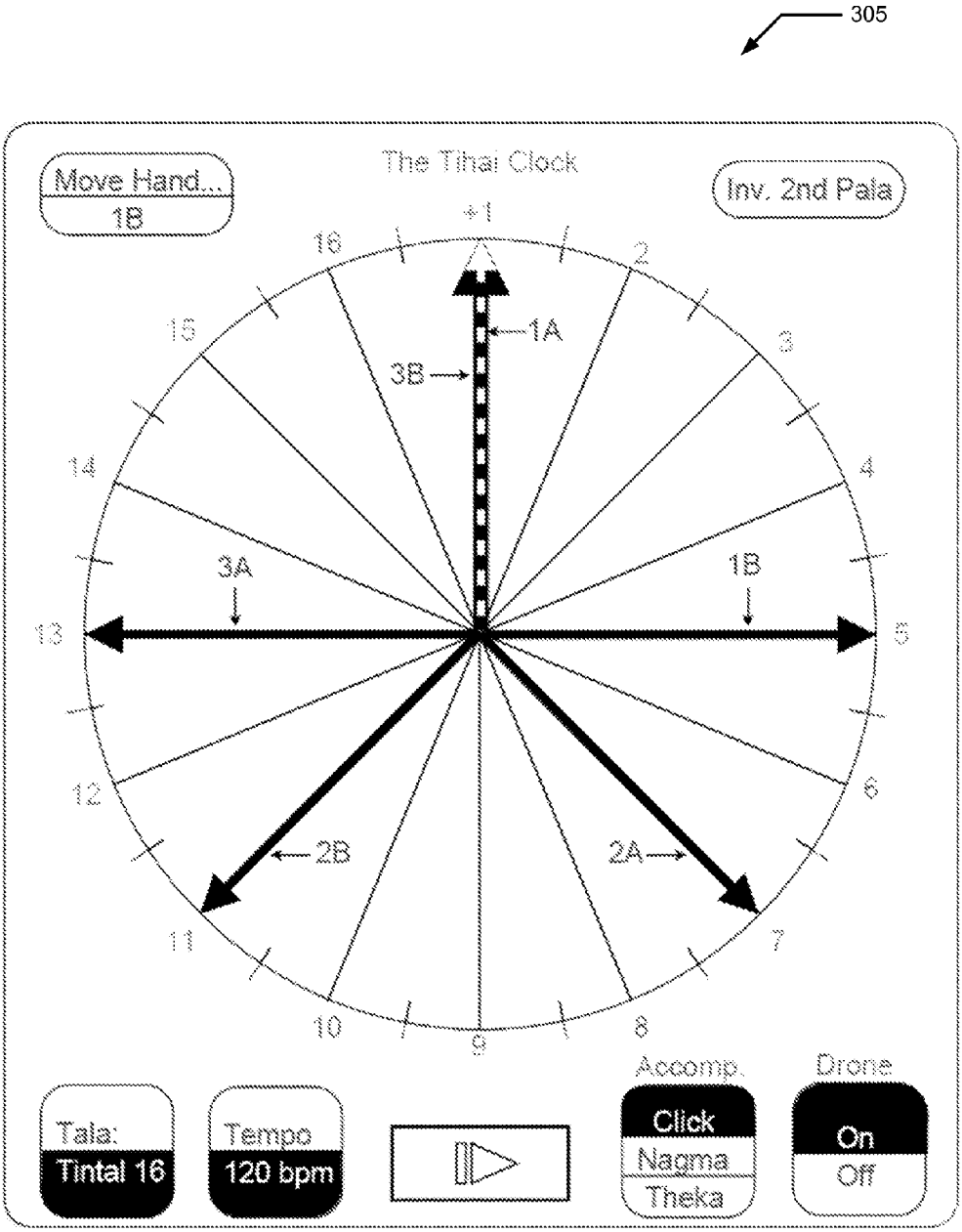

FIG. 3 illustrates a first example 305 of a user interaction with the startup screen of FIG. 2. In first example 305, the user begins with the default hand configuration of screen 205. First example 305 illustrates an example of B Motion by moving hand 1B from beat 1 to beat 5. In B motion, Δ1B:(−0.5)Δ2A:

(0.5)Δ2B:(−1)Δ3A. That is, since hand 1B moved 4 beats forward (positive/clockwise) from beat 1 to beat 5, hand 2A moves backward (negative/counterclockwise) 2 beats from beat 9 to beat 7, hand 2B moves forward (positive/clockwise) 2 beats from beat 9 to beat 11, and hand 3A moves backward (negative/counterclockwise) 4 beats from beat 1 to beat 13.

Notation for "Playing" (or Rendering) Example 1:

| | | | | | | | | | | | | | | | | |
|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 1 |
| * | pala1 | | * | gap | * | | | pala2 | | * | gap | * | | pala3 | | * |

That is, pala1 extends from beat 1 to beat 5, a gap from beat 5 to beat 7, pala2 extends from beat 7 to beat 11, a gap from beat 11 to beat 13, and pala3 extends from beat 13 to beat 1.

Figure 4:
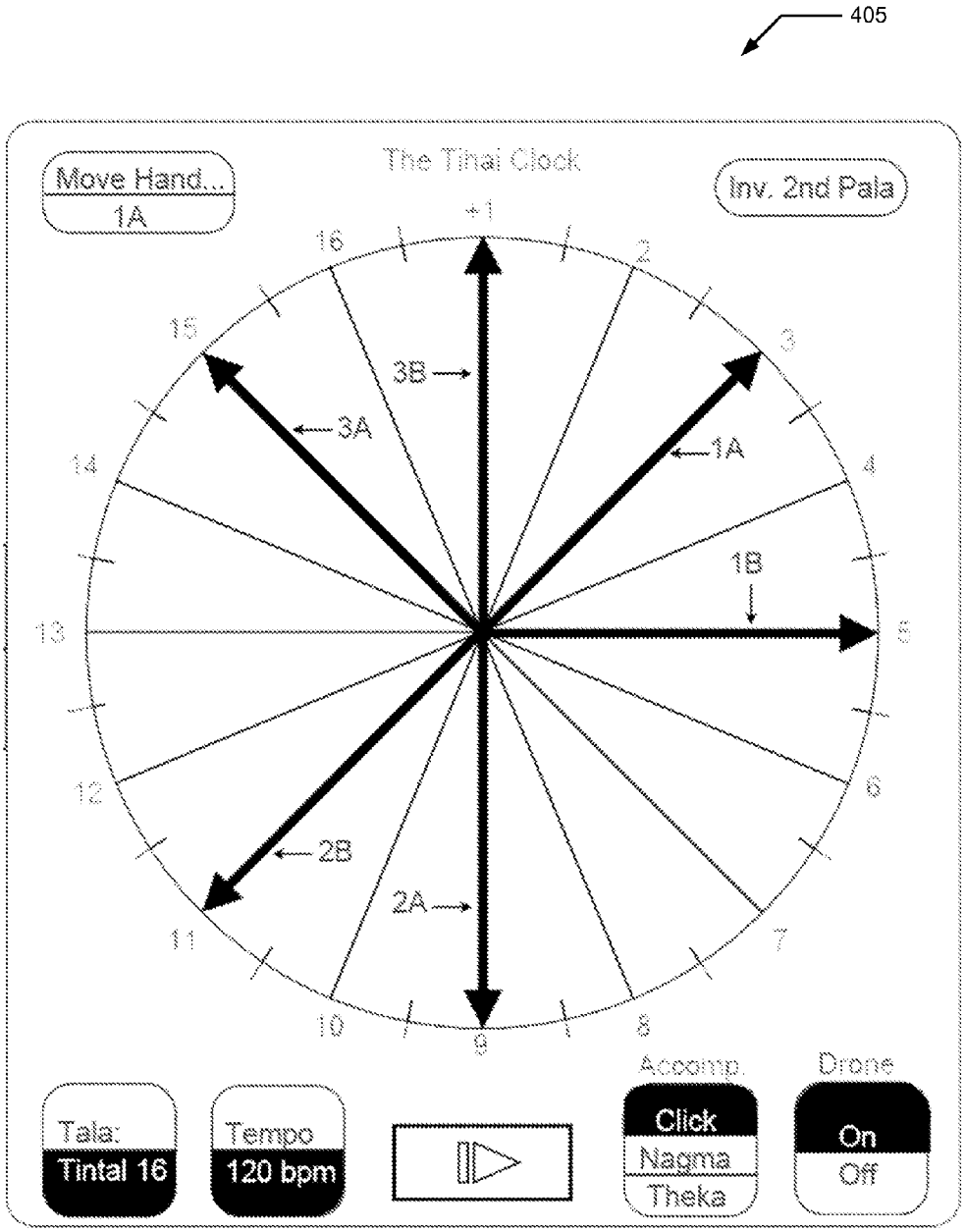

FIG. 4 illustrates a second example 405 of a user interaction with first example 305 of FIG. 3. In second example 405, the user begins with the resulting hand configuration of first example 305. Second example 405 illustrates an example of A Motion by moving hand 1A from beat 1 to beat 3. In A Motion, Δ1A:Δ2A:Δ3A. That is, since hand 1A moved 2 beats forward from beat 1 to beat 3, hand 2A moves forward 2A beats from beat 7 to beat 9, and hand 3A moves forward from beat 13 to beat 15.

Notation for "Playing" (or Rendering) Example 2:

| | | | | | | | | | | | | | | | | |
|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 1 |
| | | * | pala1 | * | gap | | * | pala2 | * | | gap | | | * | pala3 | * |

That is, pala1 extends from beat 3 to beat 5, a gap from beat 5 to beat 9, pala2 extends from beat 9 to beat 11, a gap from beat 11 to beat 15, and pala3 extends from beat 15 to beat 1.

Figure 5:
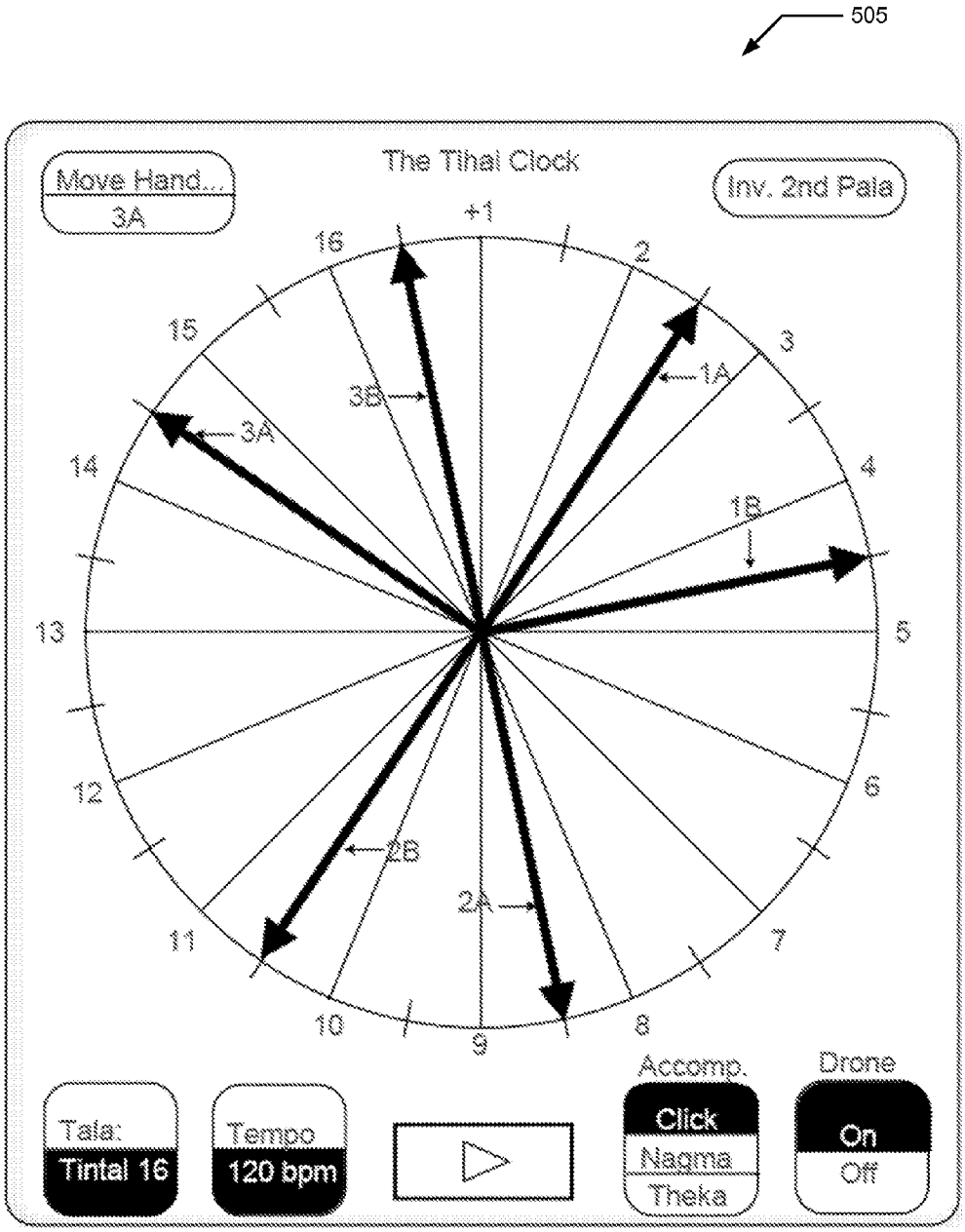

FIG. 5 illustrates a third example 505 of a user interaction with second example 405 of FIG. 4. In third example 505, the user begins with the resulting hand configuration of second example 405. Third example 505 illustrates an example of C Motion by moving hand 3B from beat 1 to beat 16.5. In C Motion, Δ1A:Δ1B:Δ2A:Δ2B:Δ3A:Δ3B, which are all −0.5. Thus all hands move backwards ½ beat.

Notation for "Playing" (or Rendering) Example 3:

| | | | | | | | | | | | | | | | | |
|---|---|---|---|---|---|---|---|---|---|---|---|---|---|---|---|---|
| 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 1.5 |
| | * | pala1 | * | | gap | | * | pala2 | * | | gap | | * | pala3 | * | |

That is, pala1 extends from beat 2.5 to beat 4.5, a gap from beat 4.5 to beat 8.5, pala2 extends from beat 8.5 to beat 10.5, a gap from beat 10.5 to beat 14.5, and pala3 extends from beat 14.5 to beat 16.5.

Figure 6:
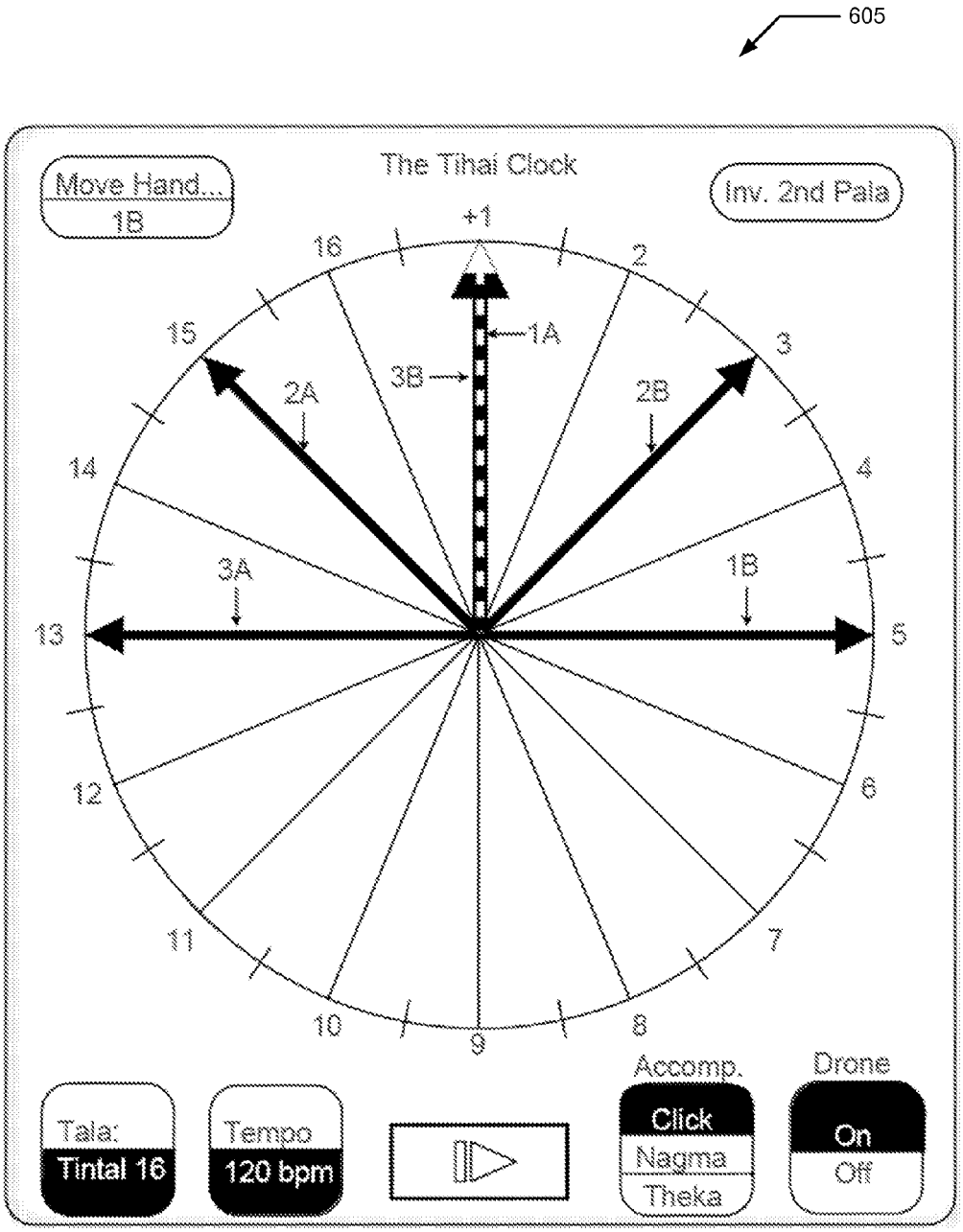

FIG. 6 illustrates a fourth example 605 of a user interaction with first example 305 of FIG. 3. In fourth example 605, the user begins with the resulting hand configuration of first example 305. Fourth example 605 illustrates an example of inversion of the $2^{nd}$ pala by flipping hand 2A from beat 7 to beat 15 and flipping hand 2B from beat 11 to beat 3.

Notation for "Playing" (or Rendering) Example 4:

| | | | | | | | | | | | | | | | | |
|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 1 |
| * | pala1 | | * | | | | | | | gap | | | | * | pala2 => | |
| 1 | 2 | 3 | 4 | 5 | 6 | 7 | 8 | 9 | 10 | 11 | 12 | 13 | 14 | 15 | 16 | 1 |
| =>pala2 | | * | | | | | | gap | | | | * | | pala3 | | * |

That is, pala1 extends from beat 1 to beat 5, a gap from beat 5 to beat 15, pala2 extends from beat 15 of a first cycle to beat 3 of a second cycle, a gap from beat 3 to beat 13, and pala3 extends from beat 13 to beat 1.

The system and methods above has been described in general terms as an aid to understanding details of preferred embodiments of the present invention. In the description herein, numerous specific details are provided, such as examples of components and/or methods, to provide a thorough understanding of embodiments of the present invention. The input/output system for interacting with the rhythm engine is dependent upon the implementation of the rhythm engine—for a mechanical system having a set of interrelated planetary gears that automatically enforce the stated relationships of the indicators, moving one or more of the indicators automatically causes other indicators to move appropriately. For a rhythm engine embodied in software/hardware controlling rendering/visualization of indicators presented on a display, which may be touch sensitive, the user touches various parts of the cycle/indicator to select an indicator to be moved, or where an indicator that has been highlighted in some fashion, is to be repositioned. Other systems may include manual/numeric input into a configuration dialog including suitable control elements. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time. The sequence of operations described herein can be interrupted, suspended, or otherwise controlled by another process, such as an operating system, kernel, and the like. The routines can operate in an operating system environment or as stand-alone routines occupying all, or a substantial part, of the system processing. Functions can be performed in hardware, software, or a combination of both. Unless otherwise stated, functions may also be performed manually, in whole or in part.

In the description herein, numerous specific details are provided, such as examples of components and/or methods, to provide a thorough understanding of particular embodiments. One skilled in the relevant art will recognize, however, that a particular embodiment can be practiced without one or more of the specific details, or with other apparatus, systems, assemblies, methods, components, materials, parts, and/or the like. In other instances, well-known structures, materials, or operations are not specifically shown or described in detail to avoid obscuring aspects of particular embodiments.

A "computer-readable medium" for purposes of particular embodiments may be any medium that can contain, store, communicate, propagate, or transport the program for use by or in connection with the instruction execution system, apparatus, system, or device. The computer readable medium can be, by way of example only but not by limitation, an electronic, magnetic, optical, electromagnetic, infrared, or semiconductor system, apparatus, system, device, propagation medium, or computer memory.

Particular embodiments can be implemented in the form of control logic in software or hardware or a combination of both. The control logic, when executed by one or more processors, may be operable to perform that which is described in particular embodiments.

A "processor" or "process" includes any human, hardware and/or software system, mechanism or component that processes data, signals, or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems.

Reference throughout this specification to "one embodiment", "an embodiment", "a specific embodiment", or "particular embodiment" means that a particular feature, structure, or characteristic described in connection with the particular embodiment is included in at least one embodiment and not necessarily in all particular embodiments. Thus, respective appearances of the phrases "in a particular embodiment", "in an embodiment", or "in a specific embodiment" in various places throughout this specification are not necessarily referring to the same embodiment. Furthermore, the particular features, structures, or characteristics of any specific embodiment may be combined in any suitable manner with one or more other particular embodiments. It is to be understood that other variations and modifications of the particular embodiments described and illustrated herein are possible in light of the teachings herein and are to be considered as part of the spirit and scope.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above. The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A method for generating a rhythmic cycle represented by a set of indicators, the method comprising:

(a) rendering the set of indicators relative to a beat cycle pattern using a machine, said beat cycle pattern including a number N beats per cycle, the set of indicators including 6 indicators that have a predefined relative dependent motion relationship to each other within said beat cycle pattern;

(b) repositioning a location of a first particular one indicator of the set of indicators; and thereafter (c) repositioning a location of one or more indicators of said set of indicators other than said first particular one indicator responsive to said predefined relative dependent motion relationship to generate the rhythmic cycle represented by the locations of the set of indicators within said beat cycle pattern.

2. The method of claim 1 wherein said beat cycle pattern includes a tala including a number of beats t in said tala having a number c of complete cycles, c being an integer, a sam, a first pala $p_1$ having a first starting position $p_{1a}$ and a first ending position $p_{1b}$, a second pala $p_2$ having a second starting position $p_{2a}$ and a second ending position $p_{2b}$, and a third pala $p_3$ having a third starting position $p_{1a}$ and a third ending position $p_{3b}$, with a number b beats from said sam to said first starting position $p_{1a}$ with each said pala including a number p beats; and a gap of a number g beats from said first ending position $p_{1b}$ to said second starting position $p_{2a}$ and from said second ending position $p_{2b}$ to said third starting position $p_{3a}$;

said 6 indicators each rendered at one of said positions $p_{1a}$, $p_{1b}$, $p_{2a}$, $p_{2b}$, $p_{3a}$, and $p_{3b}$; wherein relocation of any of one of said positions relocates one or more of said other positions wherein all said positions share the relationship:

when $p_{3b}=1$, $t_c=b+3*p+2*g$ and when $p_{3b}>1$, $t_c=b+3*p+2*g+(t+1-p_{3b})$;

where $b=p_{1a}-1$; $p=(p_{1b}+t*c_{1b})-p_{1a}$; $g=(p_{2a}+t*c_{2a})-(p_{1b}+t*c_{1b})$; a number $c_{1b}$ is a number of completed cycles before said $p_{1b}$ appears in said tala, $C_{1b}$ being an integer; and a number $c_{2a}$ is a number of completed cycles before said $p_{2b}$ appears in said tala, $c_{2b}$ being an integer.

3. The method of claim 2 further comprising rendering, dynamically and automatically, said tala on a circular background pattern using said 6 indicators.

4. A machine for generating a rhythmic cycle represented by a set of indicators, comprising:

a dial face defining a beat cycle pattern including a number N beats per cycle;

a rhythm engine, coupled to the set of indicators that include 6 indicators that have a predefined relative dependent motion relationship to each other within said beat cycle pattern, configured to position a location of each of said 6 indicators relative to said dial face; and an interface configured to reposition a location of a first particular one indicator of the set of indicators;

wherein said rhythm engine automatically repositions a location of one or more indicators of said set of indicators other than said first particular one indicator responsive to said predefined relative dependent motion relationship to generate the rhythmic cycle represented by the locations of the set of indicators within said beat cycle pattern.

5. The machine of claim 4 wherein said rhythm engine includes an executive subsystem including one or more processors coupled to a non-transitory computer readable storage medium comprising software encoded in one or more tangible media for execution by the one or more processors and when executed configured to generate the rhythmic cycle.

6. The machine of claim 4 wherein said rhythm engine includes a set of planetary gears coupled to a physical set of dials representing the set of indicators.

7. The machine of claim 4 wherein said beat cycle pattern includes a tala including a number of beats t in said tala having a number c of complete cycles, c being an integer, a sam, a first pala $p_1$ having a first starting position $p_{1a}$ and a first ending position $p_{1b}$, a second pala $p_2$ having a second starting position $p_{2a}$ and a second ending position $p_{2b}$, and a third pala $p_3$ having a third starting position $p_{3a}$ and a third ending position $p_{3b}$, with a number b beats from said sam to said first starting position $p_{1a}$ with each said pala including a number p beats; and a gap of a number g beats from said first ending position $p_{1b}$ to said second starting position $p_{2a}$ and from said second ending position $p_{2b}$ to said third starting position $p_{3a}$;

said 6 indicators each rendered at one of said positions $p_{1a}$, $p_{1b}$, $p_{2a}$, $p_{2b}$, $p_{3a}$, and $p_{3b}$; wherein relocation of any of one of said positions relocates one or more of said other positions wherein all said positions share the relationship:

when $p_{3b}=1$, $t_c=b+3*p+2*g$ and when $p_{3b}>1$, $t_c=b+3*p+2*g+(t+1-p_{3b})$;

where $b=p_{1a}-1$; $p=(p_{1b}+t*c_{1b})-p_{1a}$; $g=(p_{2a}+t*c_{2a})-(p_{1b}+t*c_{1b})$; a number $c_{1b}$ is a number of completed cycles before said $p_{1b}$ appears in said tala, $c_{1b}$ being an integer; and a number $c_{2a}$ is a number of completed cycles before said $p_{2b}$ appears in said tala, $c_{2b}$ being an integer.

8. The machine of claim 7 wherein said rhythm engine is configured to dynamically and automatically render said tala on a circular background pattern using said 6 indicators.

9. A non-transitory machine readable storage medium having stored thereon a computer program for visualizing a set of six indicators rendered with respect to a cycle background, the computer program comprising a routine of set instructions for causing the machine to perform the steps of:

(a) rendering the set of indicators relative to a beat cycle pattern using a machine, said beat cycle pattern including a number N beats per cycle, the set of indicators including 6 indicators that have a predefined relative dependent motion relationship to each other within said beat cycle pattern;

(b) repositioning a location of a first particular one indicator of the set of indicators; and thereafter (c) repositioning a location of one or more indicators of said set of indicators other than said first particular one indicator responsive to said predefined relative dependent motion relationship to generate the rhythmic cycle represented by the locations of the set of indicators within said beat cycle pattern.

10. The storage medium of claim 9 wherein said beat cycle pattern includes a tala including a number of beats t in said tala having a number c of complete cycles, c being an integer, a sam, a first pala $p_1$ having a first starting position $p_{1a}$ and a first ending position $p_{1b}$, a second pala $p_2$ having a second starting position $p_{2a}$ and a second ending position $p_{2b}$, and a third pala $p_3$ having a third starting position $p_{3a}$ and a third ending position $p_{3b}$, with a number b beats from said sam to said first starting position $p_{1a}$ with each said pala including a number p beats; and a gap of a number g beats from said first ending position $p_{1b}$ to said second starting position $p_{2a}$ and from said second ending position $p_{2b}$ to said third starting position $p_{3a}$;

said 6 indicators each rendered at one of said positions $p_{1a}$, $p_{1b}$, $p_{2a}$, $p_{2b}$, $p_{3a}$, and $p_{3b}$; wherein relocation of any of one of said positions relocates one or more of said other positions wherein all said positions share the relationship:

when $p_{3b}=1$, $t_c=b+3*p+2*g$ and when $p_{3b}>1$, $t_c=b+3*p+2*g+(t+1-p_{3b})$;

where $b=p_{1a}-1$; $p=(p_{1b}+t*c_{1b})-p_{1a}$; $g=(p_{2a}+t*c_{2a})-(p_{1b}+t*c_{1b})$; a number $c_{1b}$ is a number of completed cycles before said $p_{1b}$ appears in said tala, $c_{1b}$ being an integer; and a number $c_{2a}$ is a number of completed cycles before said $p_{2b}$ appears in said tala, $c_{2b}$ being an integer.

11. The storage medium of claim 10 wherein said tala is dynamically and automatically rendered on a circular background pattern using said 6 indicators.

* * * * *